US011365558B2

(12) United States Patent
Simon

(10) Patent No.: US 11,365,558 B2
(45) Date of Patent: Jun. 21, 2022

(54) ADJUSTABLE AND CONFIGURABLE DOOR PULL AND INSTALLATION METHOD THEREOF

(71) Applicant: Triangle Brass Manufacturing Co., Inc, Los Angeles, CA (US)

(72) Inventor: Martin Simon, Long Beach, CA (US)

(73) Assignee: Triangle Brass Manufacturing Co., Inc, Los Angeles, CA (US)

( * ) Notice: Subject to any disclaimer, the term of this patent is extended or adjusted under 35 U.S.C. 154(b) by 0 days.

(21) Appl. No.: 15/444,167

(22) Filed: Feb. 27, 2017

(65) Prior Publication Data

US 2018/0340348 A1 Nov. 29, 2018

Related U.S. Application Data

(60) Provisional application No. 62/350,033, filed on Jun. 14, 2016.

(51) Int. Cl.

| | |
|---|---|
| ***E05B 3/04*** | (2006.01) |
| ***E05B 1/00*** | (2006.01) |
| ***E05B 63/00*** | (2006.01) |

(52) U.S. Cl.

CPC ..... *E05B 3/04* (2013.01); *E05B 1/0015* (2013.01); *E05B 63/0056* (2013.01); *E05Y 2900/132* (2013.01)

(58) Field of Classification Search

CPC .... E05B 1/0015; Y10T 16/458; Y10T 16/459; Y10T 16/513; Y10T 16/498

See application file for complete search history.

(56) References Cited

U.S. PATENT DOCUMENTS

| | | | | | |
|---|---|---|---|---|---|
| 470,888 | A * | 3/1892 | Flanagen | H01M 50/256 | 16/444 |
| 636,784 | A * | 11/1899 | Flanagen | H01M 50/256 | 16/444 |
| 765,737 | A * | 7/1904 | Keil | E05B 1/0015 | 16/412 |
| 1,313,683 | A * | 8/1919 | Garami | E05B 1/0015 | 16/438 |
| 2,961,694 | A * | 11/1960 | May | E05B 1/0015 | 16/412 |
| 3,017,657 | A * | 1/1962 | Mills | E05B 1/0015 | 16/413 |
| 3,222,732 | A * | 12/1965 | Miller | E05B 1/0015 | 49/460 |

(Continued)

FOREIGN PATENT DOCUMENTS

| | | | | |
|---|---|---|---|---|
| DE | 10132344 B4 | * | 12/2005 | E05B 1/0015 |
| EP | 2098664 A1 | * | 9/2009 | A61L 2/238 |
| JP | 2002204763 A | * | 7/2002 | |

OTHER PUBLICATIONS

Deltana Hardware Catalog 2009 (Year: 2009).*
Deltana hardware catalogue selection, 2009 catalaogue (Year: 2009).*

*Primary Examiner* — Victor D Batson
*Assistant Examiner* — Matthew J Sullivan
(74) *Attorney, Agent, or Firm* — The Iwashko Law Firm, PLLC; Lev Ivan Gabriel Iwashko

(57) ABSTRACT

An adjustable door pull to be installed on a first surface of a door, the adjustable door pull including a grip, and at least one detachable standoff removably coupled to the grip to allow the grip to be attached to the first surface of the door.

11 Claims, 10 Drawing Sheets

(56) References Cited

U.S. PATENT DOCUMENTS 4,646,491 A * 3/1987 Munch ..... E05D 5/0246 52/207
4,912,809 A * 4/1990 Scheuer ..... E05B 1/0015 16/413
6,463,628 B1 * 10/2002 Yeh ..... E05B 1/0015 16/412
6,543,089 B2 * 4/2003 Tasman ..... E05B 1/0015 16/412
6,578,235 B2 * 6/2003 Womack ..... E05B 1/0015 16/412
6,966,101 B2 * 11/2005 Chiang ..... E05B 1/0015 16/412
7,219,394 B2 * 5/2007 Wu ..... E05B 1/0015 16/412
7,263,744 B2 * 9/2007 Kim ..... E05B 1/0015 16/412
7,357,467 B2 * 4/2008 Lee ..... A47B 95/02 16/422
7,640,630 B2 * 1/2010 Lee ..... F25D 23/028 16/413
7,665,810 B2 * 2/2010 Crompton ..... F25D 23/10 312/204
7,861,463 B1 * 1/2011 Nottage ..... E05B 1/0015 49/460
8,523,126 B2 * 9/2013 Garrels ..... A47K 17/022 211/105.1
9,909,338 B1 * 3/2018 Abrahams ..... E05B 1/0015
9,945,151 B2 * 4/2018 Giacomini ..... E05B 1/0015
2009/0211014 A1 * 8/2009 Forrest ..... A47K 17/022 4/576.1
2011/0179603 A1 * 7/2011 Edelen ..... A47B 95/02 16/415
2016/0084567 A1 * 3/2016 Fernandez ..... E05B 1/0015 312/405

* cited by examiner

ADJUSTABLE AND CONFIGURABLE DOOR PULL AND INSTALLATION METHOD THEREOF

CROSS-REFERENCE TO RELATED APPLICATIONS

This application claims priority under 35 USC § 120 from U.S. Provisional Application No. 62/350,033, filed on Jun. 14, 2016, in the United Stated Patent and Trademark Office, the disclosure of which is incorporated herein in its entirety.

BACKGROUND

1. Field

The present general inventive concept relates to improvements to a conventional door pull, and more particularly, to an adjustable and configurable door pull, and installation method thereof.

2. Description of the Related Art

Shopping malls, office-buildings, businesses, hospitals, gymnasiums, universities, schools, and other non-residential, and even residential-type edifices, often include doors that are designed to require door pulls as door-opening mechanisms. A conventional door pull may be installed either on both sides of a door, or on one side of a door with a different alternative door-opening mechanism on the other side of the door, such as a push plate, door handle, or touch bar.

Online locks are networked with the rest of a facility's access control system, so decision-making is done in real-time on a central hub, rather than at a door. These online locks provide greater capabilities than offline locks, including remote management, automatic alerts, and different user access levels. Online locks can be either wired or wireless, depending on an end-user's needs.

The conventional door pull typically includes one, two, or three permanently fixed standoffs, which allow the door pull to be installed away from the door at a predetermined distance, thereby allowing a user to wrap a hand around the door pull and duly comply with industry standards and/or requirements of various regulations such as the Americans with Disabilities Act (ADA).

Oftentimes, door manufacturers are different from door pull manufacturers, for at least the reason that a consumer, customer, or user may desire to purchase the door from one manufacturer, and the door pull from a different manufacturer. As such, when constructing a building, for example, the consumer typically places an order with a first manufacturer for a certain number of doors, and includes specifications for the doors to include pre-drilled holes to allow door pulls, which are ordered from a second manufacturer, to be installed on the doors.

However, due to specification imperfections, misread specifications, mis-measured drillings, and other types of human-error, the doors are often delivered to the consumer with the pre-drilled holes improperly spaced apart. As a result, the conventional door pulls cannot be installed on the doors because center-to-center distances between the permanently fixed standoffs do not properly correspond to the pre-drilled holes of the doors, and therefore, either the doors or the door pulls must be reordered. Consequently, time and money are both wasted during the process of reordering properly predrilled doors or re-configured door pulls. Moreover, even if the doors are delivered without pre-drilled holes, thereby requiring the consumer to drill the holes himself/herself, the consumer must be careful to drill the holes to be spaced-apart perfectly, to allow the door pulls to be installed on the doors.

In addition, if the doors are delivered with a pre-drilled cylinder hole for installation of a door lock, then door pulls with offset standoffs may be required to allow the consumer to access the door lock. As such, if the door pulls are ordered and delivered without offset standoffs, then the door pulls must be reordered, thereby wasting time and money.

Also, an office manager may desire to decorate an office with a certain theme during various parts of the year, such as during holidays, for example. Therefore, in October, the office manager may decorate the office in orange and black, to correspond to Halloween-type decorations and colorings. As another example, the office manager may want to decorate the office in red and pink for Valentine's day in February. However, conventional door pulls are typically provided in one color, and cannot be customized after installation.

Additionally, a consumer may want to permanently include a particular design, logo, or word on a door pull, push plate, door handle, or touch bar. However, manufacturers of door pulls, push plates, door handles, and touch bars do not offer such customized features on their hardware.

Furthermore, it is often preferable to maintain a sanitary environment in various buildings, such as hospitals, schools, and universities. Hospital Acquired infections (HAI) number over 103,000 cases per year nationally. Combined with home and school acquired infections the total rises to over 2 million every year causing lost work days and absenteeism. The cost of treatment of those occurrences is estimated between $35 and $46 billion dollars annually and is rising. However, conventional door pulls are not designed to reduce an amount of bacteria that is inadvertently transferred to the conventional door pulls from hands of various different users.

Therefore, there is a need for door pulls that allow a consumer to easily adjust standoffs based on the consumer's preferences and/or requirements.

Also, there is a need for door pulls and other hardware that allow the consumer to change and/or customize an appearance thereof.

Finally, there is a need for door pulls and other hardware that reduce an amount of bacteria on surfaces thereof.

SUMMARY

The present general inventive concept provides an adjustable and configurable door pull, and an installation method thereof.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing an adjustable doer pull to be installed on a first surface of a door, the adjustable door pull including a grip, and at least one detachable standoff removably coupled to the grip to allow the grip to be attached to the first surface of the door.

The at least one detachable standoff may include an attachment portion having an aperture info which the grip is inserted, and a protruding portion to extend from the attachment portion at a first end thereof, such that a second end opposite with respect to the first end contacts and attaches to the first surface of the door.

The protruding portion may include an aperture to allow the attachment portion to be coupled to the grip, and a screw to be inserted fully into the aperture of the protruding portion until the screw also inserts at least partially into the aperture of the attachment portion to couple the attachment portion to the grip.

The adjustable door pull may further include a through bolt to be inserted through a hole from a second surface of the door, the through bolt comprising a threaded portion to screw into the aperture of the protruding portion to fix the protruding portion to the first surface of the door.

The adjustable door pull may further include a shoulder bolt, including comprising a first end to screw into the aperture of the protruding portion, and a second end to be inserted into another aperture of another protruding portion of another at least one detachable standoff of another adjustable door pull.

The adjustable door pull may further include at least one auxiliary set screw to be screwed into at least one auxiliary set screw hole of the another protruding portion of the another at least one detachable standoff to secure the shoulder bolt to the another adjustable door pull.

The at least one detachable standoff may include an attachment portion having an aperture into which the grip is inserted, and a protruding portion, including an offset portion to extend away from the grip in a first direction, and an attaching leg portion to extend from the offset portion in a second direction different from the first direction to attach the protruding portion to the first surface of the door.

The attachment portion may include an set screw hole into which a set screw may be inserted to fix the attachment portion of the at least one detachable standoff to the grip.

The adjustable door pull may further include at least one removable end cap disposed at at least one end of the grip.

At least one of the grip and the at least one detachable standoff may include a copper alloy.

The foregoing and/or other features and utilities of the present general inventive concept may also be achieved by providing a method of installing an adjustable door pull onto a first surface of a door, the method including sliding a first end of a grip into an aperture of a first detachable standoff to correspond to a first hole at the first surface of the door, sliding a second end of the grip into an aperture of a second detachable standoff to correspond to a second hole at the first surface of the door, securing the first detachable standoff end the second detachable standoff to the grip, inserting a first through-bolt through the first hole at a second surface of the door, screwing in the first through-bolt into the first set screw hole at to secure the first detachable standoff to the door, inserting a second through-bolt through the second hole at the second side of the door, and screwing in the second through-bolt into the second set screw hole to secure the second detachable standoff to the door.

The securing of the first detachable standoff and the second detachable standoff to the grip may include inserting a first set screw into a first set screw hole of the first detachable standoff, and inserting a second set screw into a second set screw hole of the second detachable standoff.

The foregoing and/or other features and utilities of the present general inventive concept may also be achieved by providing a method of installing two adjustable pulls onto a door, the method including sliding a first end of a first grip into an aperture of a first detachable standoff to correspond to a first hole at a first side of a door, sliding a second end of the first grip into an aperture of a second detachable standoff to correspond to a second hole at the first side of the door, securing the first detachable standoff and the second detachable standoff to the first grip, respectively, sliding a first end of a second grip into an aperture of a third detachable standoff to correspond to the first hole at the first side of the door, sliding a second end of the second grip into an aperture of a fourth detachable standoff to correspond to the second hole at the first side of the door, securing the third detachable standoff and the fourth detachable standoff to the second grip, respectively, screwing a first shoulder bolt into the first set screw hole of the first detachable standoff, screwing a second shoulder bolt info the second set screw bole of the second detachable standoff, inserting the first shoulder bolt through the first hole at the first side of the door while simultaneously inserting the second shoulder bolt through the second hole at the first side of the door, inserting the first shoulder bolt into the third set screw hole of the third detachable standoff, while simultaneously inserting the second shoulder bolt info the fourth set screw hole of the fourth detachable standoff, securing the third detachable standoff to the first shoulder bolt, and securing the fourth detachable standoff to the second shoulder bolt.

Securing the first detachable standoff and the second detachable standoff to the first grip, respectively, may include inserting a first set screw into a first set screw hole of the first detachable standoff, and inserting a second set screw into a second set screw hole of the second detachable standoff, securing the third detachable standoff and the fourth detachable standoff to the second grip, respectively, may include inserting a third set screw into a third set screw hole of the third detachable standoff, and inserting a fourth set screw into a fourth set screw hole of the fourth detachable standoff, securing the third detachable standoff to the first shoulder bolt may include inserting a fifth set screw info a fifth set screw hole of the third detachable standoff, and inserting a sixth set screw into a sixth set screw hole of the third detachable standoff, and securing the fourth detachable standoff to the second shoulder bolt may include inserting a seventh set screw into a seventh set screw hole of the fourth detachable standoff, and inserting an eighth set screw into an eighth set screw hole of the fourth detachable standoff.

BRIEF DESCRIPTION OF THE DRAWINGS

These and/or other features and utilities of the present general inventive concept will become apparent and more readily appreciated from the following description of the embodiments, taken in conjunction with the accompanying drawings of which.

DETAILED DESCRIPTION

Various example embodiments will now be described more fully with reference to the accompanying drawings in which some example embodiments are illustrated. In the figures, the thicknesses of lines, layers and/or regions may be exaggerated for clarify.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like or similar elements throughout the description of the figures.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

Figure 1:
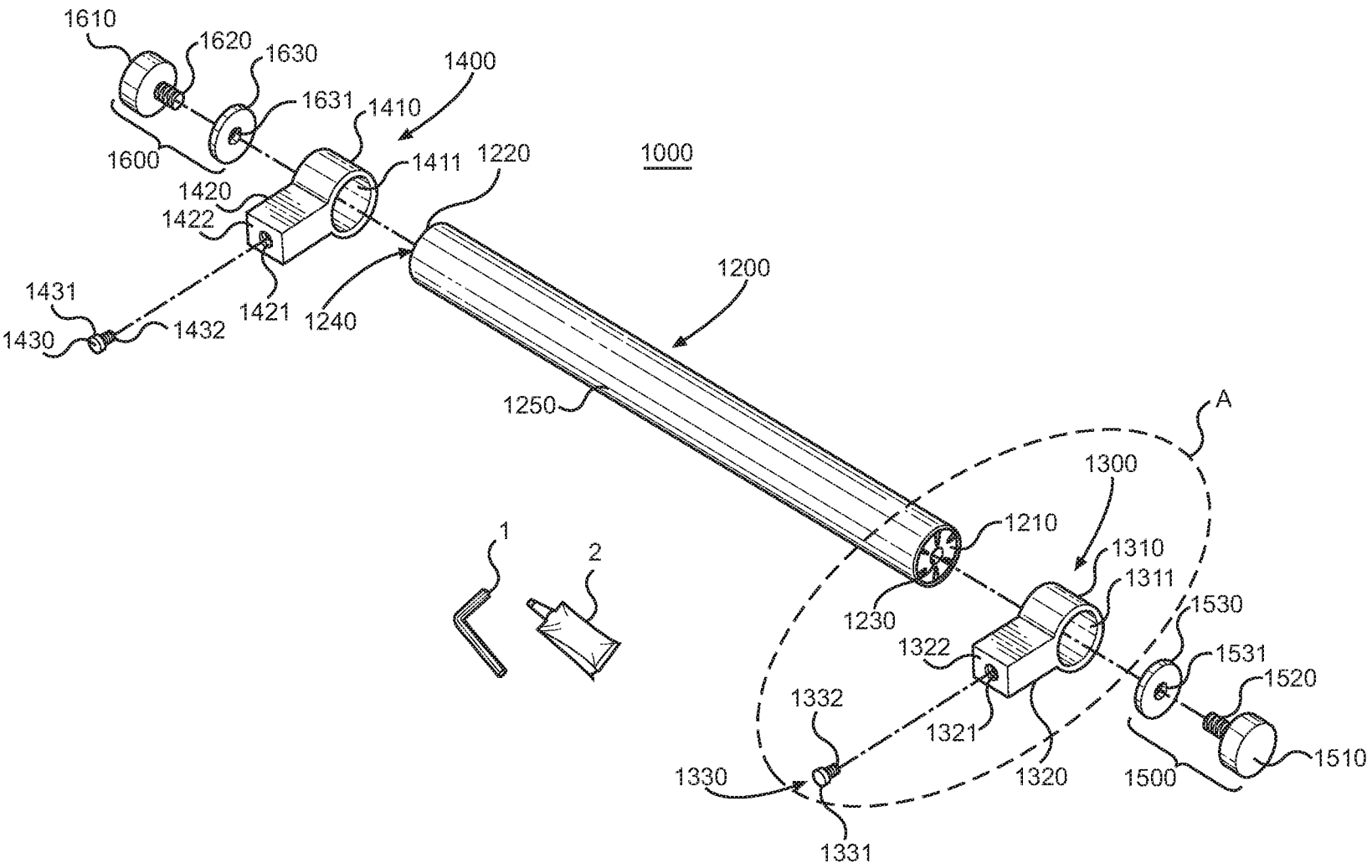
FIG. 1 is an exploded-view illustrating an adjustable door pull according to an exemplary embodiment of the present general inventive concept.

FIG. 1 is an exploded-view illustrating an adjustable door pull 1000, according to an exemplary embodiment of the present general inventive concept.

Referring to FIG. 1, the adjustable door pull 1000 may include a grip 1200, a first detachable standoff 1300, a second detachable standoff 1400, a first removable end cap 1500, and a second removable end cap 1600.

The grip 1200 (a.k.a., a handle 1200) may be provided to have various lengths, based on a user's preference. More specifically, the user may desire the grip 1200 to be anywhere between six inches long to ten feet long, based on a type of door the grip 1200 is designed to open, and may be even shorter or longer based on the user's preference. The grip 1200 may also be provided in various widths based on the user s preference. Finally the grip 1200 may be provided in various shapes, including, but not limited to, cylindrical, triangular, square, hexagonal, and octagonal.

The grip 1200 may include a first end 1210, a second end 1220, a first grip nut 1230 disposed at the first end 1210, a second grip nut 1240 disposed at the second end 1220, and a lateral surface 1250.

The first detachable standoff 1300 may include an attachment portion 1310 and a leg 1320.

The attachment portion 1310 may include an aperture 1311, which may be designed to correspond to a shape of the grip 1200, in order to allow the grip 1200 to slide into and be disposed within the aperture 1311.

The leg 1320 (a.k.a., a protruding portion 1320) may include a set screw hole 1321 to receive a set screw 1330 therein. The set screw hole 1321 may be disposed on an attachment surface 1322 of the leg 1320. The set screw 1330 may be inserted into the set screw hole 1321 to allow the user to use an alien wrench 1 at a first end 1331 of the set screw 1330 to tighten the set screw 1330 within the set screw hole 1321. When the set screw 1330 is tightened within the set screw hole 1321, a second end 1332 of the set screw 1330 contacts the lateral surface 1250 of the grip 1200. The set screw 1330 may first be snug-tightened within the set screw hole 1321 before being fully tightened. In order to ensure that the first detachable standoff 1300 is disposed at a proper location on the grip 1200. Preferably the set screw 1330 is tightened within the set screw hole 1321 until the grip 1200 can no longer move within the aperture 1311. An optional adhesive 2 may be applied to the set screw 1330 prior to insertion within the set screw hole 1321, in order to prevent, the set screw 1330 from being unscrewed from the set screw hole 1321.

The second detachable standoff 1400 may include an attachment portion 1410 and a leg 1420.

The attachment portion 1410 may include an aperture 1411, which may be designed to correspond to a shape of the grip 1200, in order to allow the grip 1200 to slide into and be disposed within the aperture 1411.

The leg 1420 (a.k.a., a protruding portion 1420) may include a set screw hole 1421 to receive a set screw 1430 therein. The set screw hole 1421 may be disposed on an attachment surface 1422 of the leg 1420. The set screw 1430 may be inserted into the set screw hole 1421 to allow the user to use the alien wrench 1 at a first end 1431 of the set screw 1430 to tighten the set screw 1430 within the set screw hole 1421. When the set screw 1430 is tightened within the set screw hole 1421, a second end 1432 of the set screw 1430 contacts the lateral surface 1250 of the grip 1200. The set screw 1430 may first be snug-tightened within the set screw hole 1421 before being fully tightened, in order to ensure that the second detachable standoff 1400 is disposed at a proper location on the grip 1200. Preferably, the set screw 1430 is tightened within the set screw hole 1421 until the grip 1200 can no longer move within the aperture 1411. The optional adhesive 2 may be applied to the set screw 1430 prior to insertion within the set screw hole 1421, in order to prevent the set screw 1430 from being unscrewed from the set screw hole 1421.

The first removable end cap 1500 may include a cap portion 1510, a threaded stud 1520, and a removable insert 1530. The threaded stud 1520 may be designed to be removably screwed into the first grip nut 1230 disposed at the first end 1210 of the grip 1200. The removable insert 1530 may include an aperture 1531 to allow the threaded stud 1520 to be inserted therethrough. As such, the removable insert 1530 may be optionally inserted between the cap portion 1510 of the first removable end cap 1500 and the first end 1210 of the grip 1200.

The second removable end cap 1600 may include a cap portion 1610, a threaded stud 1620 and a removable insert 1630. The threaded stud 1620 may be designed to be removably screwed into the second grip nut 1240 disposed at the second end 1220 of the grip 1200. The removable insert 1630 may include an aperture 1631 to allow the threaded stud 1620 to be inserted therethrough. As such, the removable insert 1630 may optionally be inserted between the cap portion 1610 of the second removable end cap 1600 and the second end 1220 of the grip 1200.

As a result, the user may change the removable inserts 1530 and 1630, as well as the cap portions 1510 and 1610, respectively, in order to include desired colors to correspond to certain times of the year, various holidays, or even company-based or university-based colors, for example.

Although two standoffs (i.e., the first detachable standoff 1300 and the second detachable standoff 1400) are illustrated in the embodiment of FIG. 1 as well as other embodiments, the present general inventive concept is not limited thereto, and a single standoff can be included, as well as three or more standoffs, based on a length of the grip.

Figure 2:
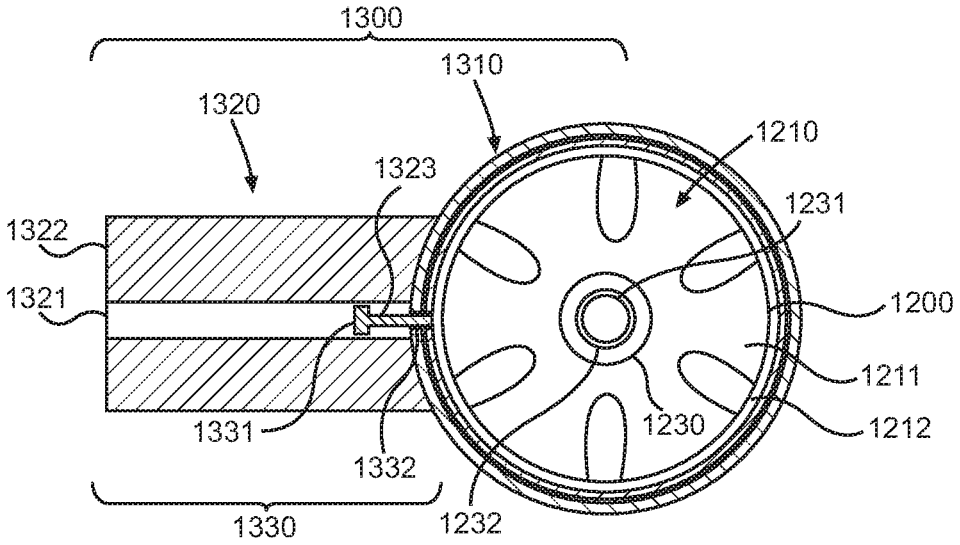
FIG. 2 is an exploded-view illustrating a mounting of an assembled adjustable door pull onto a door, according to an exemplary embodiment of the present general inventive concept.

FIG. 2 is a zoomed-In side-view perspective of a portion A of FIG. 1 such that the set screw 1330 is already disposed within the set screw hole 1321, according to an exemplary embodiment of the present general inventive concept.

As illustrated in FIG. 2, the set screw 1330 is already disposed within the set screw hole 1321. To attach the first detachable standoff 1300 to the grip 1200, the user may insert the grip 1200 into the aperture 1311 of the attachment portion 1310. Then, in order to secure the first detachable standoff 1300 to the grip 1200, the user may turn the first end 1331 of the set screw 1330 such that the set screw 1330 continues to enter a threaded portion 1323 of the set screw hole 1321. When the second end 1332 of the set screw 1330 contacts the lateral surface 1250 of the grip 1200, the first detachable standoff 1300 is secured to the grip 1200. As stated above, the optional adhesive 2 may be applied to the set screw 1330 prior to insertion within the set screw hole 1321, in order to prevent the set screw 1330 from being unscrewed from the set screw hole 1321.

Referring to FIGS. 1 and 2, the first side 1210 of the grip 1200 may include a first grip nut holding portion 1211, which allows the first grip nut 1230 to be disposed at a substantially center portion of the first side 1210. The first grip nut 1230 may include a threaded portion 1231 to allow the threaded stud 1520 of the first removable end cap 1500 to be inserted and tightened within an aperture 1232 of the first grip nut 1230. The first side 1210 of the grip 1200 may also include at least one aperture to prevent deformation of the first grip nut holding portion 1211 as a result of heat expansion and/or contraction.

Figure 3:
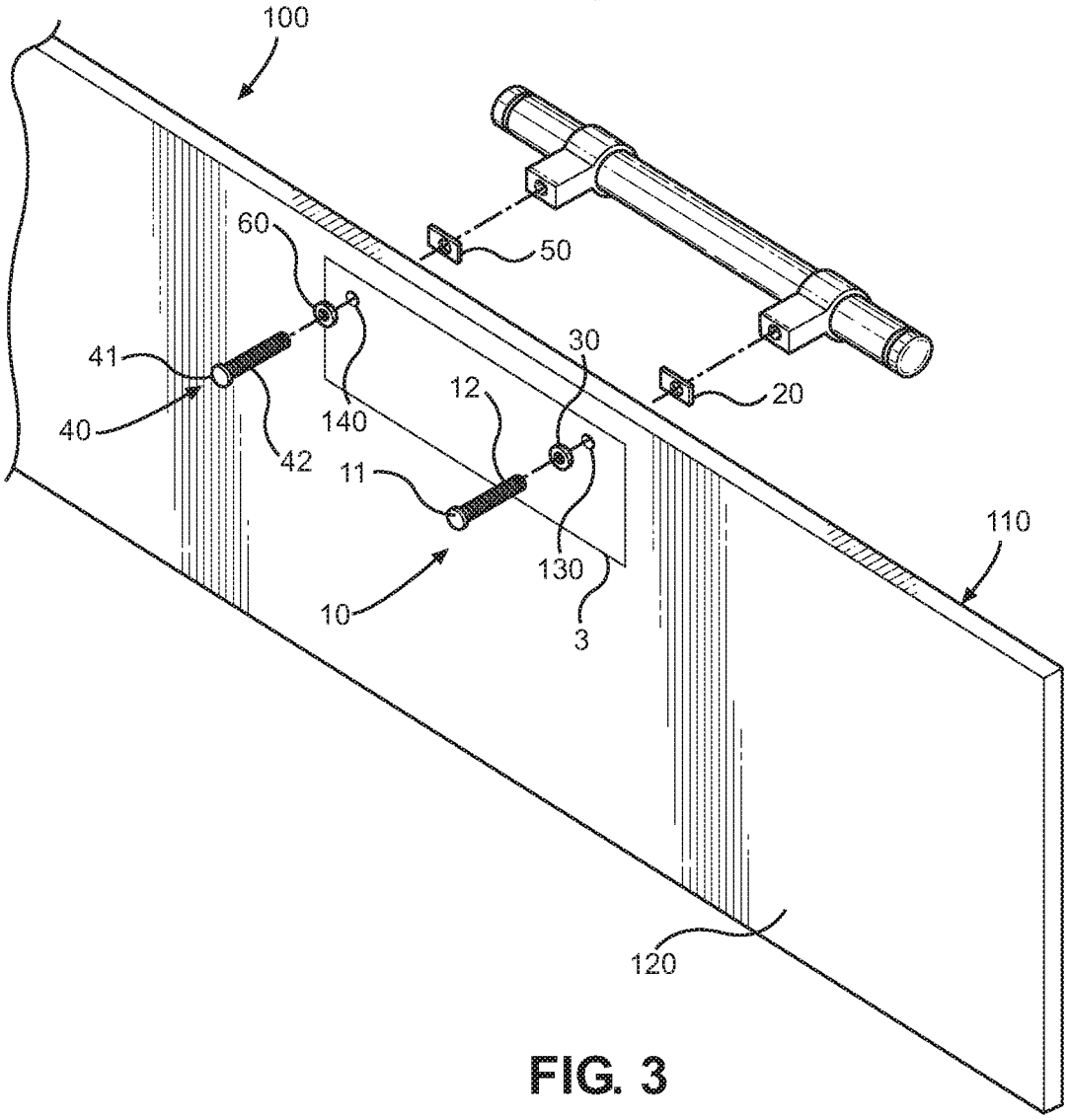
FIG. 3 is an exploded-view illustrating a mounting of an assembled adjustable door pull onto a door, according to an exemplary embodiment of the present general inventive concept.

FIG. 3 is an exploded-view illustrating a mounting of an assembled adjustable door pull 1000 onto a door 100, according to an exemplary embodiment of the present general inventive concept.

The door 100 may include an exterior surface 110, an interior surface 120, a first hole 130, and a second hole 140.

Referring to FIG. 3, a through-bolt 10 may be inserted through the first hole 130 from a side of the door 100 at the interior surface 120, such that a head 11 of the through-bolt 10 remains at the side of the door at the interior surface 120, while a threaded portion 12 of the through-bolt 10 is inserted within the first hole 130 to protrude out from another side of the door 100 at the exterior surface 110. The threaded portion 12 of the through-bolt 10 may be inserted and screwed into the set screw hole 1321 of the leg 1320 of the first detachable standoff 1300. When the through-bolt 10 is fully tightened within the set screw hole 1321, the attachment surface 1322 of the leg 1320 of the first detachable standoff 1300 may directly contact the exterior surface 120 of the door 100. Alternatively, a gasket 20 may be inserted between the exterior surface 120 of the door 100 and the attachment surface 1322 of the leg 1320 of the first detachable standoff 1300. Also, a washer 30 may be inserted between the head 11 of the through-bolt 10 and the interior surface 910 of the door 100. Inclusion of the gasket 20 and the washer 30 prevents damage to the door 100, while also allowing the adjustable door pull 1000 to be more securely attached to the door 100.

Referring again to FIG. 3, a through-bolt 40 may be inserted through the second hole 140 from the side of the door 100 at the interior surface 120, such that a head 41 of the through-bolt 40 remains at the side of the door at the interior surface 120, while a threaded portion 42 of the through-bolt 40 is inserted within the second hole 140 to protrude out from the another side of the door 100 at the exterior surface 110. The threaded portion 42 of the through-bolt 40 may be inserted and screwed into the set screw hole 1421 of the leg 1420 of the second detachable standoff 1400. When the through-bolt 40 is fully tightened within the set screw hole 1421, the attachment surface 1422 of the leg 1420 of the second detachable standoff 1400 may directly contact the exterior surface 120 of the door 100. Alternatively, a gasket 50 may be inserted between the exterior surface 120 of the door 100 and the attachment surface 1422 of the leg 420 of the second detachable standoff 1400. Also, a washer 80 may be inserted between the head 41 of the through-bolt 40 and the interior surface 110 of the door 100. Inclusion of either or both of the gasket 50 and the washer 80 prevents damage to the door 100, while also allowing the adjustable door pull 1000 to be more securely attached to the door 100.

As illustrated in FIG. 3, when the adjustable door pull 1000 is mounted on the exterior surface 120 of the door 100, an alternative door-opening mechanism 3 may be mounted on the interior surface 110 of the door 100. The alternative door-opening mechanism 3 may include a push plate, a door handle, or a touch bar, but is not limited thereto. Although the adjustable door pull 1000 has been illustrated in FIG. 2 to be mounted on the exterior surface 120 of the door 100, alternatively, the adjustable door pull 1000 may be mounted on the interior surface 110 of the door 100. When the adjustable door pull 1000 is mounted on the interior surface 110 of the door 100, the alternative door-opening mechanism 3 may be mounted on the exterior surface 120 of the door 100.

Figure 4:
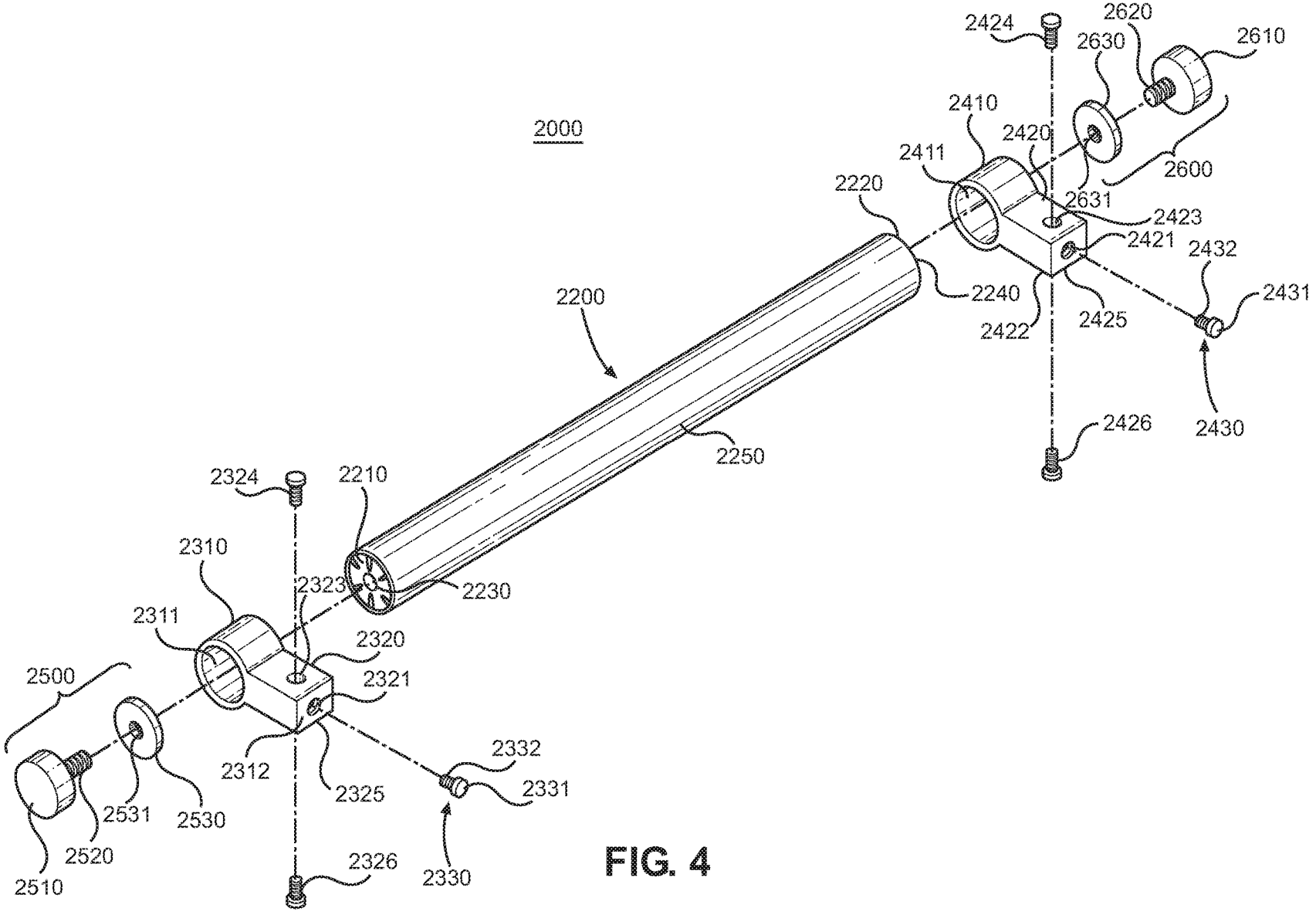
FIG. 4 is an exploded-view illustrating an adjustable door pull, according to another exemplary embodiment of the present general inventive concept.

FIG. 4 is an exploded-view illustrating an adjustable door pull 2000, according to another exemplary embodiment of the present general inventive concept.

Referring to FIG. 4, the adjustable door pull 2000 may include a grip 2200, a first detachable standoff 2300, a second detachable standoff 2400, a first removable end cap 2500, and a second removable end cap 2600.

The grip 2200 (a.k.a., a handle 2200) may be provided to have various lengths, based on a user's preference. More specifically, the user may desire the grip 2200 to be anywhere between six inches long to six feet long, based on a type of door the grip 2200 is designed to open. The grip 2200 may also be provided in various widths based on the user's preference. Finally the grip 2200 may be provided in various shapes, including, but not limited to, cylindrical, triangular, square, hexagonal, and octagonal.

The grip 2200 may include a first end 2210, a second end 2220, a first grip nut 2230 disposed at the first end 2210, a second grip nut 2240 disposed at the second end 2220, and a lateral surface 2250.

The first detachable standoff 2300 may include an attachment portion 2310 and a leg 2320.

The attachment portion 2310 may include an aperture 2311, which may be designed to correspond to a shape of the grip 2200, in order to allow the grip 2200 to slide into and be disposed within the aperture 2311.

The leg 2320 (a.k.a., a protruding portion 2320) may include a set screw and shoulder bolt receiving hole 2321 to receive a set screw 2330 therein. The set screw and shoulder bolt receiving hole 2321 may be disposed on an attachment surface 2322 of the leg 2320. The set screw 2330 may be inserted into the set screw and shoulder bolt receiving hole 2321 to allow the user to use the alien wrench 1 at a first end 2331 of the set screw 2330 to tighten the set screw 2330 within the set screw and shoulder bolt receiving hole 2321. When the set screw 2330 is tightened within the set screw and shoulder bolt receiving hole 2321, a second end 2332 of the set screw 2330 contacts the lateral surface 2250 of the grip 2200. The set screw 2330 may first be snug-tightened within the set screw and shoulder bolt receiving hole 2321 before being fully tightened, in order to ensure that the first detachable standoff 2300 is disposed at a proper location on the grip 2200. Preferably, the set screw 2330 is tightened within the set screw and shoulder bolt receiving hole 2321 until the grip 2200 can no longer move within the aperture 2311. An optional adhesive 2 may be applied to the set screw 2330 prior to insertion within the set screw and shoulder bolt receiving hole 2321, in order to prevent the set screw 2330 from being unscrewed from the set screw and shoulder bolt receiving hole 2321.

The leg 2320 may also include a first auxiliary set screw hole 2323 to receive a first auxiliary set screw 2324 and a second auxiliary set screw hole 2325 to receive a second auxiliary set screw 2326.

The second detachable standoff 2400 may include an attachment portion 2410 and a leg 1420.

The attachment portion 2410 may include an aperture 2411, which may be designed to correspond to a shape of the grip 2200, in order to allow the grip 2200 to slide into and be disposed within the aperture 2411.

The leg 2420 (a.k.a., a protruding portion 2420) may include a set screw hole 2421 to receive a set screw 2430 therein. The set screw hole 2421 may be disposed on an attachment surface 2422 of the leg 2420. The set screw 2430 may be inserted into the set screw hole 2421 to allow the user to use an alien wrench 1 at a first end 2431 of the set screw 2430 to tighten the set screw 2430 within the set screw hole 2421. When the set screw 2430 is tightened within the set screw hole 2421, a second end 2432 of the set screw 2430 contacts the lateral surface 2250 of the grip 2200. The set screw 2430 may first be snug-tightened within the set screw hole 2421 before being fully tightened, in order to ensure that the second detachable standoff 2400 is disposed at a proper location on the grip 2200. Preferably, the set screw 2430 is tightened within the set screw hole 2421 until the grip 2200 can no longer move within the aperture 2411. The optional adhesive 2 may be applied to the set screw 2430 prior to insertion within the set screw hole 2421, in order to prevent the set screw 2430 from being unscrewed from the set screw hole 2421.

The leg 2420 may also include a first auxiliary set screw hole 2423 to receive a first auxiliary set screw 2424 and a second auxiliary set screw 2425 hole to receive a second auxiliary set screw 2426.

The first removable end cap 2500 may include a threaded stud 2510 and a removable insert 2520. The threaded stud 2510 may be designed to be removably screwed into the first grip nut 2230 disposed at the first end 2210 of the grip 2200. The removable insert 2520 may include an aperture 2521 to allow the threaded stud 2510 to be inserted therethrough. As such, the removable insert 2520 may be optionally inserted between the first removable end cap 2500 and the first end 2210 of the grip 2200.

The second removable end cap 2600 may include a threaded stud 2610 and a removable insert 2620. The threaded stud 2610 may be designed to be removably screwed into the second grip nut 2240 disposed at the second end 2220 of the grip 2200. The removable insert 2620 may include an aperture 2621 to allow the threaded stud 2610 to be inserted therethrough. As such, the removable insert 2620 may optionally be inserted between the second removable end cap 2600 and the second end 2220 of the grip 2200.

Figure 5:
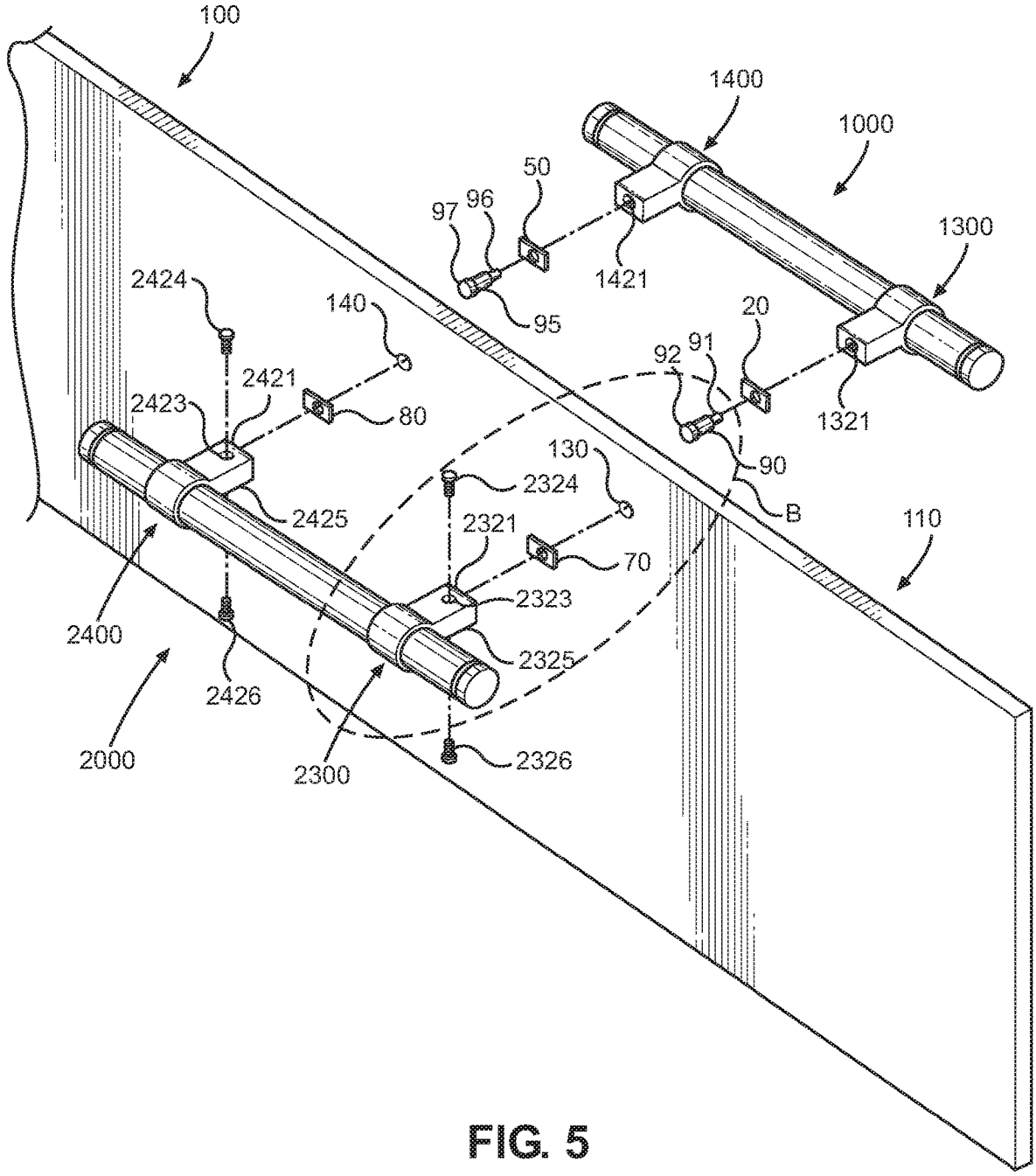
FIG. 5 is an exploded-view illustrating a mounting of the assembled adjustable door pull of FIG. 1 and an assembled adjustable door pull of FIG. 4 onto the door, according to another exemplary embodiment of the present general inventive concept.

FIG. 5 is an exploded-view illustrating a mounting of the assembled adjustable door pull 1000 of FIG. 1 and an assembled adjustable door pull 2000 of FIG. 4 onto the door 100, according to another exemplary embodiment of the present general inventive concept.

The another exemplary embodiment of FIG. 5 is directed to a mounting of the adjustable door pull 1000 on the exterior surface 120 of the door 100, and a mounting of the adjustable door pull 2000 on the interior surface 110 of the door 100.

Referring to FIG. 5, a shoulder bolt 90 may be inserted through the gasket 20, and then a threaded portion 91 of the shoulder bolt 90 may be screwed into the set screw hole 1321 of the first detachable standoff 1300. Then, in order to attach both the first detachable standoff 1300 and the first detachable standoff 2300 to the door 100, the shoulder bolt 90 may be inserted through the first hole 130 from the side of the door 100 at the exterior surface 110, such that a head 92 of the shoulder bolt 90 remains at the side of the door 100 at the interior surface 120 in order to be inserted through a gasket 70 and then inserted into the set screw and shoulder bolt receiving hole 2321 of the first detachable standoff 2300. In order to fully secure the shoulder bolt 90 to the first detachable standoff 2300, the auxiliary set screw 2324 may be screwed into the auxiliary set screw hole 2323 until it contacts a side of the shoulder bolt 90, and the auxiliary set screw 2326 may be screwed info the auxiliary set screw hole 2325 until it contacts another side of the shoulder bolt 90.

Referring again to FIG. 5, a shoulder bolt 95 may be inserted through the gasket 50, and then a threaded portion 96 of the shoulder bolt 95 may be screwed into the set screw hole 1421 of the second detachable standoff 1400. Then, in order to attach both the second detachable standoff 1400 and the second detachable standoff 2400 to the door 100, the shoulder bolt 95 may be inserted through the second hole 140 from the side of the door 100 at the exterior surface 110, such that a head 97 of the shoulder bolt 95 remains at the side of the door 100 at the interior surface 120 in order to be inserted through a gasket 80 and then inserted into the set screw and shoulder bolt receiving hole 2421 of the second detachable standoff 2400. In order to fully secure the shoulder bolt 95 to the second detachable standoff 2400, the auxiliary set screw 2424 may be screwed into the auxiliary set screw hole 2423 until it contacts a side of the shoulder bolt 95, and the auxiliary set screw 2426 may be screwed into the auxiliary set screw hole 2425 until it contacts another side of the shoulder bolt 95.

Referring to FIG. 5, although the adjustable door pull 1000 has been illustrated to be mounted on the exterior surface 120 of the door 100, and the adjustable door pull 2000 has been illustrated to be mounted on the interior surface 110 of the door 100, alternatively, the adjustable door pull 1000 may be mounted on the interior surface 120 of the door 100, and the adjustable door pull 2000 may be mounted on the exterior surface 110 of the door 100.

An optional adhesive may be applied to any set screws or auxiliary set screws in the present general inventive concept, in order to fully secure the set screws or auxiliary set screws within their respective holes.

Figure 8:
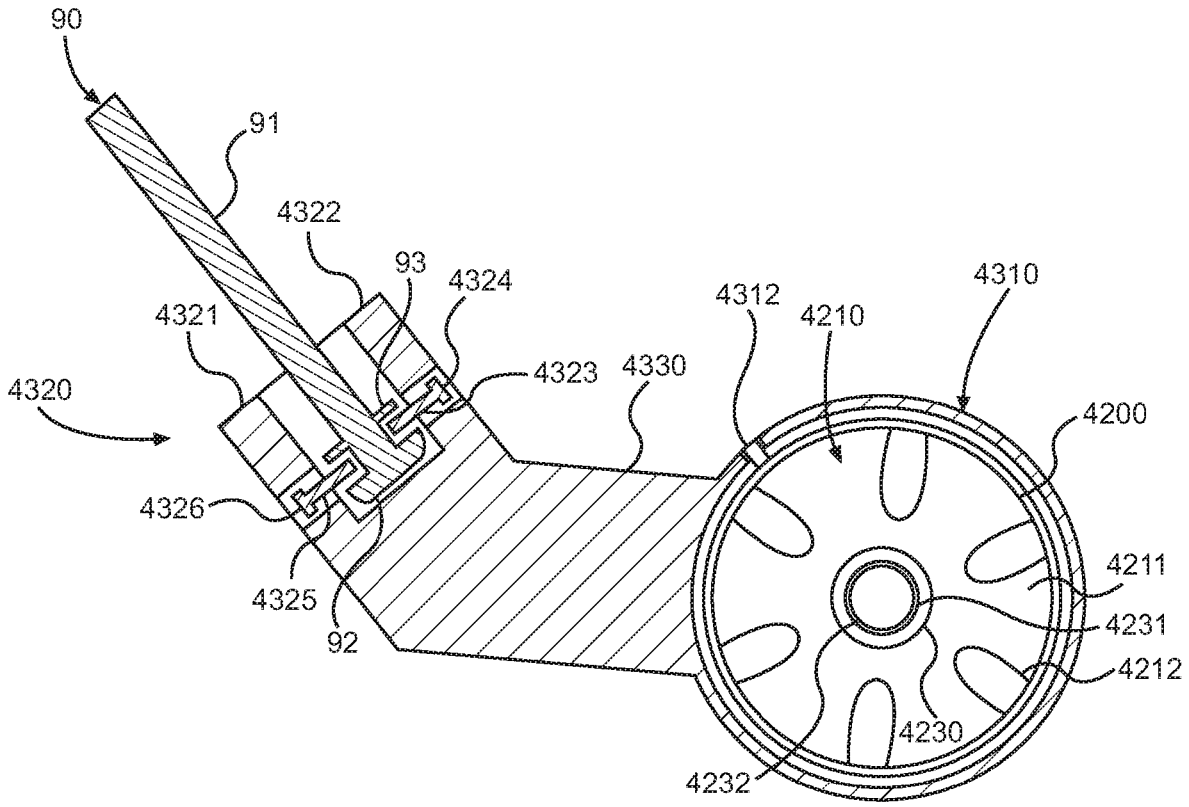
FIG. 8 is a zoomed-in side-view perspective of a portion C of FIG. 7 such that the shoulder bolt is already disposed within the bolt receiving hole, according to another exemplary embodiment of the present general inventive concept.

FIG. 8 is a zoomed-in side-view perspective of a portion B of FIG. 5 such that the shoulder bolt 90 is already disposed within the set screw and shoulder bolt receiving hole 2321, according to another exemplary embodiment of the present general inventive concept.

Figure 6:
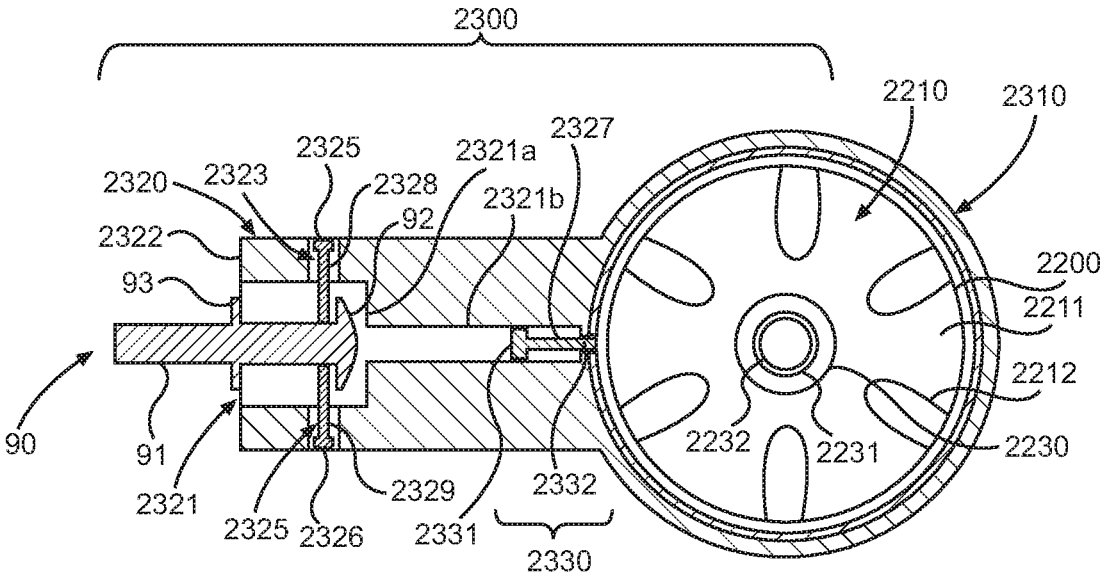
FIG. 6 is a zoomed-in side-view perspective of a portion B of FIG. 5 such that the shoulder bolt is already disposed within the set screw and shoulder bolt receiving hole, according to another exemplary embodiment of the present general inventive concept.

As illustrated in FIG. 6, the set screw 2330 is already disposed within the set screw and shoulder bolt receiving hole 2321. To attach the first detachable standoff 2300 to the grip 2200, the user may insert the grip 2200 into the aperture 2311 of the attachment portion 2310. Then, in order to secure the first detachable standoff 2300 to the grip 2200, the user may turn the first end 2331 of the set screw 2330 such that the set screw 2330 continues to enter a threaded portion 2327 of the set screw hole 2321. When the second end 2332 of the set screw 2330 contacts the lateral surface 2250 of the grip 2200, the first detachable standoff 2300 is secured to the grip 2200. As stated above, the optional adhesive 2 may be applied to the set screw 2330 prior to insertion within the set screw hole 2321, in order to prevent the set screw 2330 from being unscrewed from the set screw hole 2321.

Referring to FIGS. 5 and 6, the first side 1210 of the grip 1200 may include a first grip nut holding portion 2211, which allows the first grip nut 2230 to be disposed at a substantially center portion of the first side 2210. The first grip nut 2230 may include a threaded portion 1231 to allow the threaded stud 2520 of the first removable end cap 2500 to be inserted and tightened within an aperture 2232 of the first grip nut 2230. The first side 2210 of the grip 2200 may also include at least one aperture 2212 to prevent deformation of the first grip nut holding portion 2211 as a result of heat expansion and/or contraction.

As illustrated in FIG. 6, the shoulder bolt 90 is already disposed within the set screw and shoulder bolt receiving bole 2321. More specifically, the shoulder bolt 90 is disposed within a shoulder bolt receiving portion 2321*a* of the set screw and shoulder bolt receiving hole 2321, while the set screw 2330 is disposed within a set screw receiving portion 2321*b* of the set screw and shoulder bolt receiving hole 2321. The threaded portion 91 of the shoulder bolt 90 may be designed to be screwable within the set screw hole 1321 of the first-detachable standoff 1300. The shoulder bolt 90 may include a shoulder 93 to allow the gasket 20 to be securely disposed between the shoulder 93 and the attachment surface 1322 of the first detachable standoff 1300 at a first side of the shoulder 93. The shoulder 93 may also allow the gasket 70 to be securely disposed between the shoulder 93 and the attachment surface 2322 of the first detachable standoff 2300 at a second side of the shoulder 93. In order to fully secure the shoulder bolt 90 to the first detachable standoff 2300, the auxiliary set screw 2324 may be screwed into the auxiliary set screw bole 2323 via a threaded portion 2328, until the auxiliary set screw 2324 contacts a side of the shoulder bolt 90, and the auxiliary set screw 2326 may be screwed into the auxiliary set screw hole 2325 via a threaded portion 2329, until auxiliary set screw 2326 contacts another side of the shoulder bolt 90. The head 92 of the shoulder bolt 90 may have an enlarged bulbous shape. The auxiliary set screw 2324 and the auxiliary set screw 2326 may contact a back side of the head 92 of the shoulder holt 90, in order to prevent the shoulder bolt 90 from being unscrewed.

Figure 7:
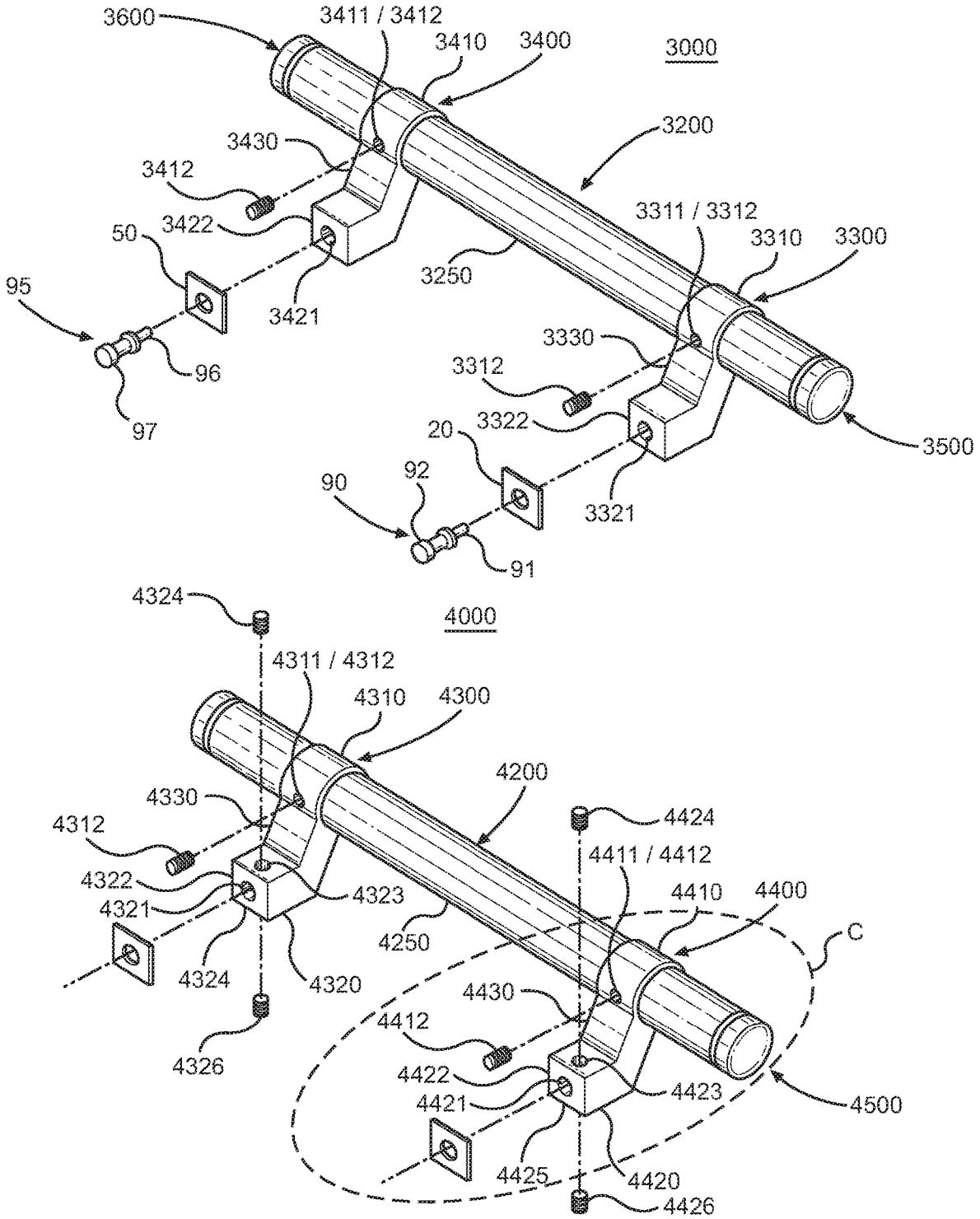
FIG. 7 is an exploded-view illustrating an adjustable door pull and another adjustable door pull, according to another exemplary embodiment of the present general inventive concept.

FIG. 7 is an exploded-view illustrating an adjustable door pull 3000 and an adjustable door pull 4000, according to another exemplary embodiment of the present general inventive concept. Similar components that have already been described will not be again described in order to prevent redundancy. Also, either or both of the adjustable door pull 3000 and the adjustable door pull 4000 of FIG. 7 may be assembled as described and illustrated in the embodiments of FIGS. 3 and 5.

Referring to FIG. 7, the adjustable door pull 3000 may include a grip 3200, a first detachable standoff 3300, a second detachable standoff 3400, a first removable end cap 3500, and a second removable end cap 3600.

The grip 3200 (a.k.a., a handle 3200) may be provided to have various lengths, based on a user's preference. More specifically, the user may desire the grip 3200 to be anywhere between six inches long to six feel long, based on a type of door the grip 3200 is designed to open. The grip 3200 may also be provided in various widths based on the user's preference. Finally, the grip 3200 may be provided in various shapes, including, but not limited to, cylindrical, triangular, square, hexagonal, and octagonal.

The first detachable standoff 3300 may include an attachment portion 3310, an attaching leg portion 3320, and an offset portion 3330.

The attachment portion 3310 may fit around the grip 3200, in order to allow the grip 3200 to slide into the attachment portion 3310. The attachment portion 3310 may include a set screw hole 3311 to receive a set screw 3312 therein. The set screw hole 3311 may be disposed on an outer surface of the attachment portion 3310. The set screw 3312 may be inserted into the set screw hole 3311 to allow the user to use the alien wrench 1 to tighten the set screw 3312 within the set screw hole 3311. When the set screw 3312 is tightened within the set screw hole 3311, the set screw 3312 may contacts a lateral surface 3250 of the grip 3200. The set screw 3312 may first be snug-tightened within the set screw hole 3311 before being fully tightened, in order to ensure that the first detachable standoff 3300 is disposed at a proper location on the grip 3200. Preferably, the set screw 3312 is tightened within the set screw hole 3311 until the grip 3200 can no longer move within an aperture of the attachment portion 3310. An optional adhesive 2 may be applied to the set screw 3312 prior to insertion within the set screw hole 3311, in order to prevent the set screw 3312 from being unscrewed from the set screw hole 3311.

As illustrated in FIG. 7, the attaching leg portion 3320 may be offset from the grip 3200 by the offset portion 3330.

The second detachable standoff 3400 may include an attachment portion 3410, an attaching leg portion 3420, and an offset portion 3430.

The attachment portion 3410 may fit around the grip 3200, in order to allow the grip 3200 to slide into the attachment portion 3410. The attachment portion 3410 may include a set screw hole 3411 to receive a set screw 3412 therein. The set screw hole 3411 may be disposed on an outer surface of the attachment portion 3410. The set screw 3412 may be inserted into the set screw hole 3411 to allow the user to use the alien wrench 1 to tighten the set screw 3412 within the set screw hole 3411. When the set screw 3412 is lightened within the set screw hole 3411, the set screw 3412 may contacts a lateral surface 3250 of the grip 3200. The set screw 3412 may first be snug-tightened within the set screw hole 3411 before being fully tightened, in order to ensure that the second detachable standoff 3400 is disposed at a proper location on the grip 3200. Preferably the set screw 3412 is tightened within the set screw hole 3411 until the grip 3200 can no longer move within an aperture of the attachment portion 3410. An optional adhesive 2 may be applied to the set screw 3412 prior to insertion within the set screw hole 3411, in order to prevent the set screw 3412 from being unscrewed from the set screw hole 3411.

As illustrated in FIG. 7, the attaching leg portion 3420 may be offset from the grip 3200 by the offset portion 3430.

Referring to FIG. 7, the adjustable door pull 4000 may include a grip 4200, a first detachable standoff 4300, a second detachable standoff 4400, a first removable end cap 4500, and a second removable end cap 4600.

The grip 4200 (a.k.a., a handle 4200) may be provided to have various lengths, based on a user's preference. More specifically the user may desire the grip 4200 to be anywhere between six inches long to six feet long, based on a type of door the grip 4200 is designed to open. The grip 4200 may also be provided in various widths based on the user's preference. Finally, the grip 4200 may be provided in various shapes, including, but not limited to, cylindrical, triangular, square, hexagonal, and octagonal.

The first detachable standoff 4300 may include an attachment portion 4310, an attaching leg portion 4320, and an offset portion 4330.

The attachment portion 4310 may fit around the grip 4200, in order to allow the grip 4200 to slide info the attachment portion 4310. The attachment portion 4310 may include a set screw hole 4311 to receive a set screw 4312 therein. The set screw hole 4311 may be disposed on an outer surface of the attachment portion 4310. The set screw 4312 may be inserted into the set screw hole 4311 to allow the user to use the alien wrench 1 to tighten the set screw 4312 within the set screw hole 4311. When the set screw 4312 is tightened within the set screw hole 4311, the set screw 4312 may contacts a lateral surface 4250 of the grip 4200. The set screw 4312 may first be snug-tightened within the set screw hole 4311 before being fully tightened. In order to ensure that the first detachable standoff 4300 is disposed at a proper location on the grip 4200. Preferably the set screw 4312 is tightened within the set screw hole 4311 until the grip 4200 can no longer move within an aperture of the attachment portion 4310. An optional adhesive 2 may be applied to the set screw 4312 prior to insertion within the set screw hole 4311, in order to prevent the set screw 4312 from being unscrewed from the set screw hole 4311.

As illustrated in FIG. 7, the attaching leg portion 4320 may be offset from the grip 4200 by the offset portion 4330.

The attaching leg portion 4300 may also include a first auxiliary set screw hole 4323 to receive a first auxiliary set screw 4324 and a second auxiliary set screw hole 4325 to receive a second auxiliary set screw 4326.

The second detachable standoff 4400 may include an attachment portion 4410, an attaching leg portion 4420, and an offset portion 4430.

The attachment portion 4410 may fit around the grip 4200, in order to allow the grip 4200 to slide into the attachment portion 4410. The attachment portion 4410 may include a set screw hole 4411 to receive a set screw 4412 therein. The set screw hole 4411 may be disposed on an outer surface of the attachment portion 4410. The set screw 4412 may be inserted into the set screw hole 4411 to allow the user to use the alien wrench 1 to tighten the set screw 4412 within the set screw hole 4411. When the set screw 4412 is tightened within the set screw hole 4411, the set screw 4412 may contacts a lateral surface 4250 of the grip 4200. The set screw 4412 may first be snug-tightened within the set screw hole 4411 before being fully tightened, in order to ensure that the second detachable standoff 4400 is disposed at a proper location on the grip 4200. Preferably, the set screw 4412 is tightened within the set screw hole 4411 until the grip 4200 can no longer move within an aperture of the attachment portion 4410. An optional adhesive 2 may be applied to the set screw 4412 prior to insertion within the set screw hole 4411, in order to prevent the set screw 4412 from being unscrewed from the set screw hole 4411.

As illustrated in FIG. 7, the attaching leg portion 4420 may be offset from the grip 4200 by the offset portion 4430.

The attaching leg portion 4400 may also include a first auxiliary set screw bole 4423 to receive a first auxiliary set screw 4424 and a second auxiliary set screw hole 4425 to receive a second auxiliary set screw 4426.

Referring to FIGS. 5 and 7, the adjustable door pull 3000 may be mounted on the exterior surface 120 of the door 100, and the adjustable door pull 4000 may be mounted on the interior surface 110 of the door 100.

Referring to FIGS. 5 and 7, a shoulder bolt 90 may be inserted through the gasket 20, and then a threaded portion 91 of the shoulder bolt 90 may be screwed into the bolt receiving hole 3321 of the first detachable standoff 3300. Then, in order to attach both the first detachable standoff 3300 and the first detachable standoff 4300 to the door 100, the shoulder bolt 90 may be inserted through the first hole 130 from the side of the door 100 at the exterior surface 110, such that a head 92 of the shoulder bolt 90 remains at the side of the door 100 at the interior surface 120 in order to be inserted through the gasket 70 and then inserted into the bolt receiving hole 4321 of the first detachable standoff 4300. In order to fully secure the shoulder bolt 90 to the first detachable standoff 4300, the auxiliary set screw 4324 may be screwed into the auxiliary set screw hole 4323 until it contacts a side of the shoulder bolt 90, and the auxiliary set screw 4326 may be screwed into the auxiliary set screw hole 4325 until it contacts another side of the shoulder bolt 90.

Referring again to FIGS. 5 and 7, a shoulder bolt 95 may be inserted through the gasket 50, and then a threaded portion 96 of the shoulder bolt 95 may be screwed into the set screw hole 3421 of the second detachable standoff 3400. Then, in order to attach both the second detachable standoff 3400 and the second detachable standoff 4400 to the door 100, the shoulder bolt 95 may be inserted through the second hole 140 from the side of the door 100 at the exterior surface 110, such that a head 97 of the shoulder bolt 95 remains at the side of the door 100 at the interior surface 120 in order to be inserted through the gasket 80 and then inserted into the set screw and shoulder bolt receiving hole 4421 of the second detachable standoff 4400. In order to fully secure the shoulder bolt 95 to the second detachable standoff 2400, the auxiliary set screw 4424 may be screwed into the auxiliary set screw hole 4423 until it contacts a side of the shoulder bolt 95, and the auxiliary set screw 4426 may be screwed into the auxiliary set screw hole 4425 until it contacts another side of the shoulder bolt 95.

As a result, the adjustable door pull 3000 may be mounted on the exterior surface 120 of the door 100, and the adjustable door pull 4000 may be mounted on the inferior surface 110 of the door 100.

Alternatively, if the user desires to install only the adjustable door pull 3000 only on one side of the door 100, then the user may apply the configuration of FIG. 3 to the present embodiment. More specifically, the threaded portion 12 of the through-bolt 10 may be inserted and screwed into the bolt receiving hole 3321 of the attaching leg portion 3320 of the first detachable standoff 3300. When the through-bolt 10 is fully tightened within the bolt receiving hole 3321, the attachment surface 3322 of the attaching leg portion 3320 of the first detachable standoff 3300 may directly contact the exterior surface 120 of the door 100. Alternatively, the gasket 20 may be inserted between the exterior surface 120 of the door 100 and the attachment surface 3322 of the attaching leg portion 3320 of the first detachable standoff 3300. Also, the washer 30 may be inserted between the head 11 of the through-bolt 10 and the inferior surface 910 of the door 100. Inclusion of the gasket 20 and the washer 30 prevents damage to the door 100, while also allowing the adjustable door pull 1000 to be more securely attached to the door 100.

FIG. 8 is a zoomed-in side-view perspective of a portion C of FIG. 7 such that the shoulder bolt 90 is already disposed within the bolt receiving hole 3321, according to another exemplary embodiment of the present general inventive concept.

As illustrated in FIGS. 7 and 8, the set screw 4312 is already disposed within the set screw hole 4311. To attach the first detachable standoff 4300 to the grip 4200, the user may insert the grip 4200 into an aperture of the attachment portion 4310. Then, in order to secure the first detachable standoff 4300 to the grip 4200, the user may turn the set screw 4312 such that the set screw 4312 continues to enter the set screw hole 4311. When the set screw 4312 contacts the lateral surface 4250 of the grip 4200, the first detachable standoff 4300 is secured to the grip 4200. As stated above, the optional adhesive 2 may be applied to the set screw 4312 prior to insertion within the set screw hole 4311, in order to prevent the set screw 4312 from being unscrewed from the set screw hole 4311.

Referring to FIGS. 7 and 8, a first side 4210 of the grip 4200 may include a first grip nut holding portion 4211, which allows a first grip nut 4230 to be disposed at a substantially center portion of the first side 4210. The first grip nut 4230 may include a threaded portion 4231 to allow the threaded stud 4520 of the first removable end cap 4500 to be inserted and tightened within an aperture 4232 of the first grip nut 4230. The first side 4210 of the grip 4200 may also include at least one aperture 4212 to prevent deformation of the first grip nut holding portion 4211 as a result of heat expansion and/or contraction.

As illustrated in FIG. 8, the shoulder bolt 90 is already disposed within the bolt receiving hole 4321. The threaded portion 91 of the shoulder bolt 90 may be designed to be screwable within the set screw hole 3321 of the first detachable standoff 3300. The shoulder bolt 90 may include a shoulder 93 to allow the gasket 20 to be securely disposed between the shoulder 93 and the attachment surface 3322 of the first detachable standoff 3300 at a first side of the shoulder 93. The shoulder 93 may also allow the gasket 70 to be securely disposed between the shoulder 93 and the attachment surface 4322 of the first detachable standoff 3300 at a second side of the shoulder 93. In order to fully secure the shoulder bolt 90 to the first detachable standoff 4300, the auxiliary set screw 4324 may be screwed into the auxiliary set screw hole 4323 via a threaded portion 4328 until the auxiliary set screw 4324 contacts a side of the shoulder bolt 90, and the auxiliary set screw 4326 may be screwed into the auxiliary set screw hole 4325 via a threaded portion 4329 until the auxiliary set screw 4326 contacts another side of the shoulder bolt 90. The head 92 of the shoulder bolt 90 may have an enlarged bulbous shape. The auxiliary set screw 4324 and the auxiliary set screw 4326 may contact a back side of the head 92 of the shoulder bolt 90, in order to prevent the shoulder bolt 90 from being unscrewed.

Figure 9:
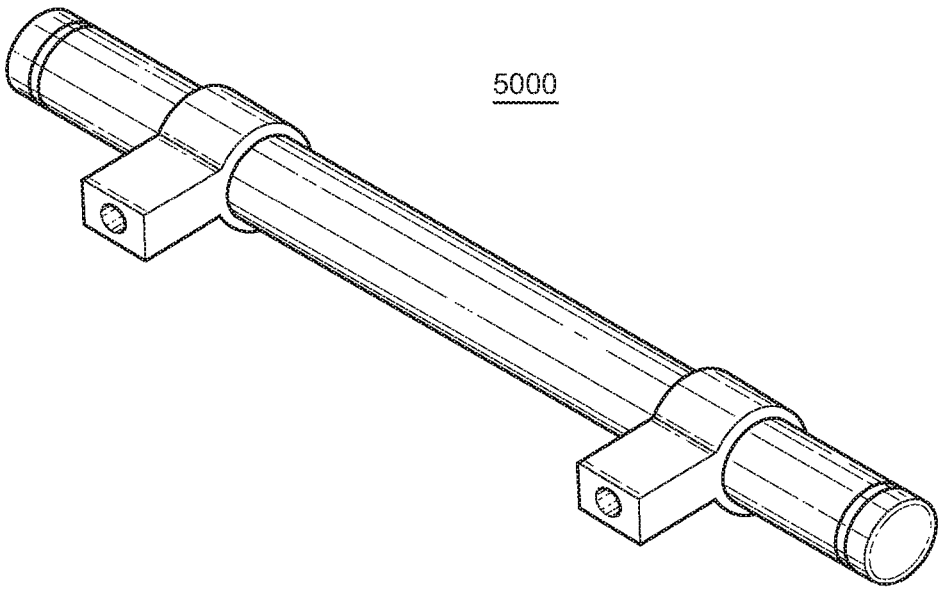
FIG. 9 is a view illustrating an assembled adjustable door pull with an etched-in "TRIMCO" word-mark, according to another exemplary embodiment of the present general inventive concept.

FIG. 9 is a view illustrating an assembled adjustable door pull 500 with an etched-in "TRIMCO" word-mark, according to another exemplary embodiment of the present general inventive concept.

It should also be noted that all of the above embodiments of the present general inventive concept may be designed, constructed, manufactured, and/or made from any type of material, including, but not limited to, metals, alloys, plastics, wood, and glass.

However, it may be preferred to use specially formulated copper alloys that are registered by the U.S. Environmental Protection Agency (EPA). When cleaned regularly, these copper alloys have been proven to kill 99.9% of the most virulent bacteria like *e-Coli*, MRSA and Staph*. This is not a coating, but rather an all-natural, solid copper-based alloy that will last for the life of the present general inventive concept.

The specially formulated copper alloys has a myriad of benefits, including, but not limited to: killing 99.9% of bacteria in 2 hours or less; being durable because it is not a coating that would wear off; killing bacteria for the lifetime of the present general inventive concept; having an appearance of stainless steel to match other hardware products; being fully recyclable; and being applicable to all types of hardware, including, but not limited to push/pull plates, door pulls, door handles, touch bars, latch sets, and pull bars.

Figure 10:
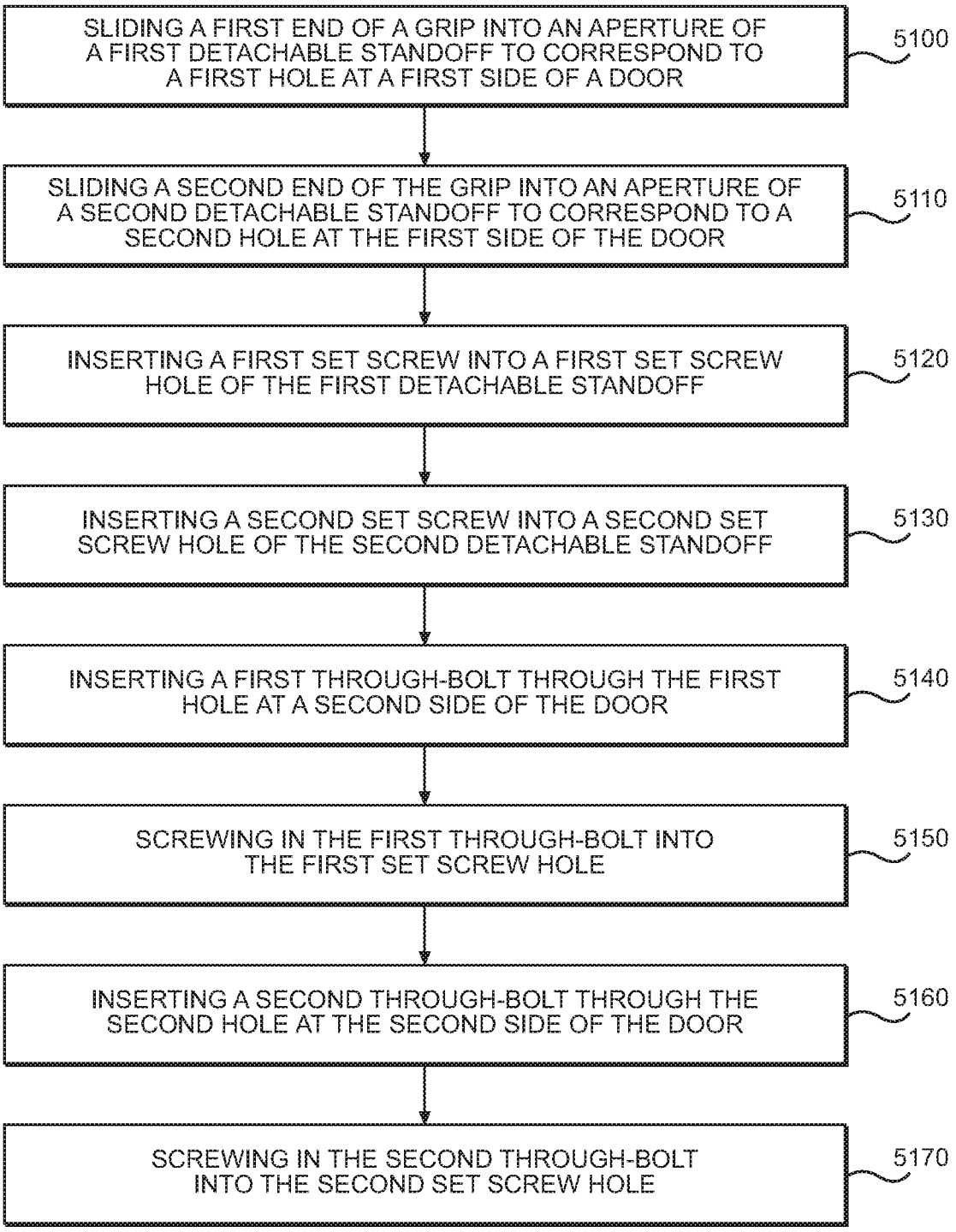
FIG. 10 illustrates a method of installing an adjustable pull onto a door, according to an exemplary embodiment of the present general inventive concept.

FIG. 10 illustrates a method of installing an adjustable pull onto a door, according to an exemplary embodiment of the present general inventive concept.

The method of FIG. 10 may include sliding a first end of a grip into an aperture of a first detachable standoff to correspond to a first hole at a first side of a door at S100, and then sliding a second end of the grip into an aperture of a second detachable standoff to correspond to a second hole at the first side of the door at S110. The method may also include inserting a first set screw into a first set screw hole of the first detachable standoff at S120, and then inserting a second set screw into a second set screw hole of the second detachable standoff at S130, thereby securing the first detachable standoff and the second detachable standoff to the grip, respectively, The method may further include inserting a first through-bolt through the first hole at a second side of the door at S140, and then screwing in the first through-bolt into the first set screw hole at S150 to secure the first detachable standoff to the door. Additionally, the method may include inserting a second through-bolt through the second hole at the second side of the door at S160, and then screwing in the second through-bolt into the second set screw hole at S170 to secure the second detachable standoff to the door.

Figure 11:
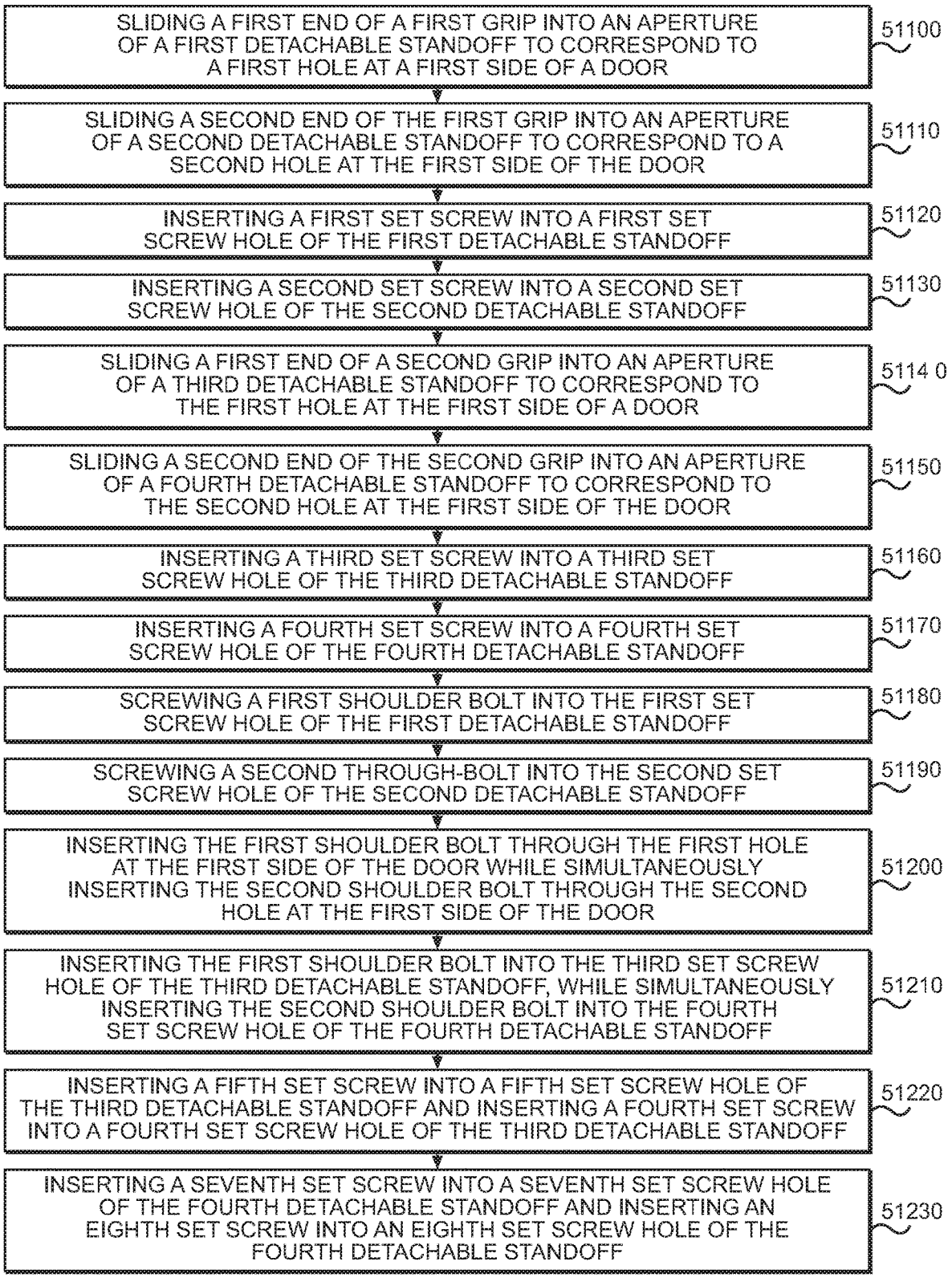
FIG. 11 illustrates a method of installing two adjustable pulls onto a door, according to another exemplary embodiment of the present general inventive concept.

FIG. 11 illustrates a method of installing two adjustable pulls onto a door, according to another exemplary embodiment of the present general inventive concept.

The method of FIG. 11 may include sliding a first end of a first grip into an aperture of a first detachable standoff to correspond to a first hole at a first side of a door at S1100, and then sliding a second end of the first grip into an aperture of a second detachable standoff to correspond to a second hole at the first side of the door at S1110. The method may also include inserting a first set screw into a first set screw hole of the first detachable standoff at S1120, and then inserting a second set screw into a second set screw hole of the second detachable standoff at S1130, thereby securing the first detachable standoff and the second detachable standoff to the first grip, respectively. Next, the method may include sliding a first end of a second grip into an aperture of a third detachable standoff to correspond to the first hole at the first side of the door at S1140, and then sliding a second end of the second grip into an aperture of a fourth detachable standoff to correspond to the second hole at the first side of the door at S1150. The method may also include inserting a third set screw info a third set screw hole of the third detachable standoff at S1160, and then inserting a fourth set screw into a fourth set screw hole of the fourth detachable standoff at S1170, thereby securing the third detachable standoff and the fourth detachable standoff to the second grip, respectively. The method may further include screwing a first shoulder bolt into the first set screw hole of the first detachable standoff at S1180, and then screwing a second shoulder bolt into the second set screw hole of the second detachable standoff at S1190. Additionally, the method may include inserting the first shoulder bolt through the first hole at the first side of the door while simultaneously inserting the second shoulder bolt through the second hole at the first side of the door at S1200. Next, the method may include inserting the first shoulder bolt into the third set screw hole of the third detachable standoff, while simultaneously inserting the second shoulder bolt into the fourth set screw hole of the fourth detachable standoff at S1210. Subsequently the method may include inserting a fifth set screw into a fifth set screw hole of the third detachable standoff and inserting a sixth set screw into a sixth set screw hole of the third detachable standoff at S1220, thereby securing the third detachable standoff to the first shoulder bolt. Further, the method may include inserting a seventh set screw into a seventh set screw hole of the fourth detachable standoff and inserting an eighth set screw into an eighth set screw hole of the fourth detachable standoff at S1230, thereby securing the fourth detachable standoff to the second shoulder bolt.

FIGS. 12A through 12F illustrate various shapes of cap portions 1510*a* through 1510*f* of first removable end caps 1500*a* through 1500*f*, respectively, according to exemplary embodiments of the present general inventive concept. The various shapes are not limited to the first removable end caps 1500*a* through 1500*f*, and may be also applied to the second removable end cap 1600, or any other embodiments of aforementioned removable end caps.

Figure 12C:
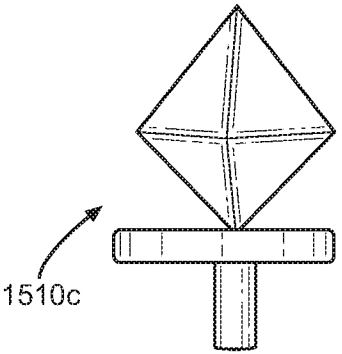
FIGS. 12A through 12F illustrate various shapes of cap portions of removable end caps, according to exemplary embodiments of the present general inventive concept.
Figure 12F:
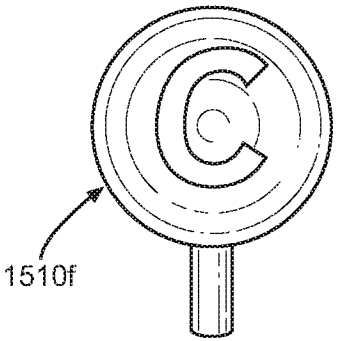
Figure 12B:
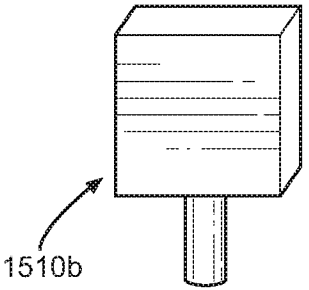
Figure 12E:
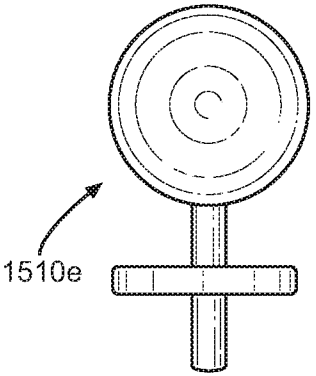
Figure 12A:
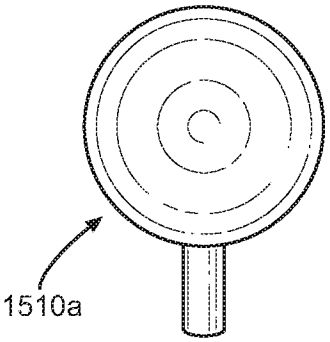

Referring to FIG. 12A, the cap portion 1510*a* has a shape of a ball, but is not limited thereto.

Referring to FIG. 12B, the cap portion 1510*b* has a shape of a square and/or cube, but is not limited thereto.

Referring to FIG. 12C, the cap portion 1510*c* has a shape of a diamond, but is not limited thereto.

Figure 12D:
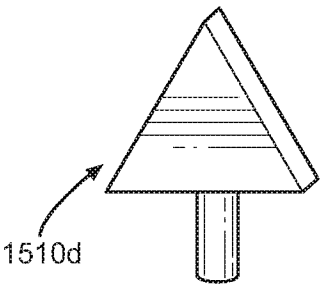

Referring to FIG. 12D, the cap portion 1510*d* has a shape of a triangle and/or pyramid, hut is not limited thereto.

Referring to FIG. 12E, the cap portion 1510*e* has a shape of a medal, but is not limited thereto.

Referring to FIG. 12F, the cap portion 1510*f* has a shape of a copyright symbol, but is not limited thereto.

Although FIGS. 12A through 12F illustrate various shapes of the first removable end caps 1500*a* through 1500*f*, the first removable end caps 1500*a* through 1500*f* may also differ in size/color/material, and may also have any other type of shape desired by the user. Furthermore, the user may etch a desired logo, trademark, or slogan onto any portion of the end cap for further personalization.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents. As such, any combinations of the above embodiments are possible.

The invention claimed is:

1. An adjustable door pull to be installed on a first surface of a door that opens an entrance through which a user can walk, the adjustable door pull comprising:

a grip attached to the first surface of the door to allow the user to pull the door open such that the user is able to walk through the entrance; and at least one detachable standoff removably coupled around a perimeter of the grip and adjustable along an entire length of the grip to allow the grip to be attached to the first surface of the door, such that the at least one detachable standoff provides the attachment between the grip and the first surface of the door, the at least one detachable standoff comprising:

an attachment portion having an aperture into which the grip is inserted, and a protruding portion, comprising:

an offset portion to extend away from the grip in a first direction, such that the grip remains substantially parallel to the door while being set away from the attachment portion at an angle less than 180 degrees, and an attaching leg portion to extend from the offset portion in a second direction different from the first direction to attach the protruding portion to the first surface of the door.

2. The adjustable door pull of claim 1 wherein the protruding portion comprises: a second aperture to allow the attachment portion to be coupled to the grip; and a screw to be inserted fully into the second aperture of the protruding portion until the screw also inserts at least partially into the aperture of the attachment portion to couple the attachment portion to the grip.

3. The adjustable door pull of claim 2, further comprising:

a through bolt to be inserted through a hole from a second surface of the door, the through bolt comprising a threaded portion to screw into the aperture of the protruding portion to fix the protruding portion to the first surface of the door.

4. The adjustable door pull of claim 2, further comprising:

a shoulder bolt, comprising:

a first end to screw into the aperture of the protruding portion, and a second end to be inserted into another aperture of another protruding portion of another at least one detachable standoff of another adjustable door pull.

5. The adjustable door pull of claim 4, further comprising:

at least one auxiliary set screw to be screwed into at least one auxiliary set screw hole of the another protruding portion of the another at least one detachable standoff to secure the shoulder bolt to the another adjustable door pull.

6. The adjustable door pull of claim 1, wherein the at least one detachable standoff comprises:

an attachment portion having an aperture into which the grip is inserted; and a protruding portion, comprising:

an offset portion to extend away from the grip in a first direction, and an attaching leg portion to extend from the offset portion in a second direction different from the first direction to attach the protruding portion to the first surface of the door.

7. The adjustable door pull of claim 1, wherein the attachment portion comprises an set screw hole into which a set screw may be inserted to fix the attachment portion of the at least one detachable standoff to the grip.

8. The adjustable door pull of claim 1, further comprising:

at least one removable end cap disposed at at least one end of the grip.

9. The adjustable door pull of claim 1, wherein at least one of the grip and the at least one detachable standoff comprises a copper alloy.

10. A method of installing an adjustable door pull onto a first surface of a door, the method comprising:

sliding a first end of a grip into an aperture of a first attachment portion of a first detachable standoff to correspond to a first hole at the first surface of the door, wherein the first detachable standoff includes a first protruding portion comprising a first offset portion to extend away from the grip in a first direction, such that the grip remains substantially parallel to the door while being set away from the first attachment portion at an angle less than 180 degrees, and a first attaching leg portion to extend from the first offset portion in a second direction different from the first direction to attach the first protruding portion to the first surface of the door;

sliding a second end of the grip into an aperture of a second attachment portion of a second detachable standoff to correspond to a second hole at the first surface of the door, wherein the second detachable standoff includes a second protruding portion comprising a second offset portion to extend away from the grip in the first direction, such that the grip remains substantially parallel to the door while being set away from the second attachment portion at an angle less than 180 degrees, and a second attaching leg portion to extend from the second offset portion in the second direction different from the first direction to attach the second protruding portion to the first surface of the door;

securing the first detachable standoff and the second detachable standoff to the grip;

inserting a first through-bolt through the first hole at a second surface of the door;

screwing in the first through-bolt into the first set screw hole at to secure the first detachable standoff to the door;

inserting a second through-bolt through the second hole at the second side of the door; and screwing in the second through-bolt into the second set screw hole to secure the second detachable standoff to the door.

11. The method of claim 10, wherein the securing of the first detachable standoff and the second detachable standoff to the grip comprises:

inserting a first set screw into a first set screw hole of the first detachable standoff; and inserting a second set screw into a second set screw hole of the second detachable standoff.

* * * * *